US008898909B2

(12) United States Patent
Schmitt

(10) Patent No.: US 8,898,909 B2
(45) Date of Patent: Dec. 2, 2014

(54) ELECTRIC SHAVER

(75) Inventor: Paul Schmitt, Fitchburg, WI (US)

(73) Assignee: Spectrum Brands, Inc., Middleton, WI (US)

( * ) Notice: Subject to any disclaimer, the term of this patent is extended or adjusted under 35 U.S.C. 154(b) by 587 days.

(21) Appl. No.: 12/862,903

(22) Filed: Aug. 25, 2010

(65) Prior Publication Data

US 2012/0047754 A1 Mar. 1, 2012

(51) Int. Cl.
*B26B 21/52* (2006.01)
*B26B 19/04* (2006.01)

(52) U.S. Cl.
CPC ..... *B26B 19/048* (2013.01)
USPC ..... 30/45; 30/527

(58) Field of Classification Search
USPC ..... 30/43.4–43.9, 43.91, 43.92, 527, 45
See application file for complete search history.

(56) References Cited

U.S. PATENT DOCUMENTS 3,396,464 A * 8/1968 Treiss ..... 30/65
3,593,416 A * 7/1971 Edson ..... 30/50
3,935,639 A * 2/1976 Terry et al. ..... 30/47
3,938,247 A 2/1976 Carbonell et al.
3,950,849 A 4/1976 Perry
3,973,323 A 8/1976 Trees
4,198,746 A 4/1980 Trotta
4,275,498 A 6/1981 Ciaffone
4,347,663 A 9/1982 Ullmo
4,403,414 A 9/1983 Kiraly et al.
4,785,534 A 11/1988 Lazarchik
4,922,608 A * 5/1990 Pahl ..... 30/43.91
4,930,217 A * 6/1990 Wolf et al. ..... 30/43.92
4,970,784 A * 11/1990 Althaus et al. ..... 30/527
5,029,391 A * 7/1991 Althaus et al. ..... 30/533
5,050,301 A * 9/1991 Apprille, Jr. ..... 30/529
5,564,191 A 10/1996 Ozawa
5,704,126 A * 1/1998 Franke et al. ..... 30/43.91
6,052,904 A * 4/2000 Wetzel et al. ..... 30/43.92
6,115,924 A * 9/2000 Oldroyd ..... 30/527
6,151,780 A * 11/2000 Klein ..... 30/43.92
6,223,442 B1 * 5/2001 Pina ..... 30/527
6,381,857 B1 * 5/2002 Oldroyd ..... 30/527
6,854,188 B1 2/2005 Wonderley
6,935,029 B2 8/2005 Morisugi et al.
7,017,270 B2 * 3/2006 Shiba et al. ..... 30/43.92
7,152,512 B1 12/2006 Prochaska
7,200,942 B2 * 4/2007 Richard ..... 30/526
7,426,785 B2 * 9/2008 Ho ..... 30/43.92
7,461,456 B2 * 12/2008 Tsushio et al. ..... 30/43.92
7,475,483 B2 1/2009 Peyser et al.

(Continued)

FOREIGN PATENT DOCUMENTS

GB 2116470 * 9/1983 ..... B26B 21/52

*Primary Examiner* — Jason Daniel Prone
(74) *Attorney, Agent, or Firm* — Armstrong Teasdale LLP

(57) ABSTRACT

An electric shaver generally includes a handle assembly and a head assembly mounted on the handle assembly. The head assembly is pivotable between a first orientation and a second orientation. A biasing element is fixed to one of the head assembly and the handle assembly and is free from being fixed to the other of the head assembly and the handle assembly. The biasing element is configured such that when the head assembly is pivoted from the first orientation into the second orientation the biasing element contacts a surface of the other of the head assembly and the handle assembly and bends to apply a counteracting force that biases the head assembly back toward the first orientation when the head assembly is not held in the second orientation.

14 Claims, 11 Drawing Sheets

(56) References Cited

U.S. PATENT DOCUMENTS

| | | | | |
|---|---|---|---|---|
| 7,574,809 | B2 | 8/2009 | Follo et al. | |
| D620,199 | S * | 7/2010 | Maguire et al. | D28/51 |
| D621,096 | S * | 8/2010 | Maguire et al. | D28/51 |
| D632,434 | S * | 2/2011 | Maguire et al. | D28/51 |
| 8,347,508 | B2 * | 1/2013 | Shimizu et al. | 30/45 |
| 8,745,882 | B2 * | 6/2014 | Murgida et al. | 30/527 |
| 8,745,883 | B2 * | 6/2014 | Murgida et al. | 30/527 |
| 2002/0011003 | A1 * | 1/2002 | Van Hout et al. | 30/43.92 |
| 2006/0021228 | A1 * | 2/2006 | Shiba et al. | 30/43.92 |
| 2007/0113409 | A1 * | 5/2007 | Schaaf | 30/43.92 |
| 2008/0034591 | A1 * | 2/2008 | Fung | 30/43.92 |
| 2009/0025229 | A1 * | 1/2009 | Kappes et al. | 30/43.92 |
| 2009/0235539 | A1 | 9/2009 | Wonderley | |
| 2009/0241343 | A1 * | 10/2009 | Yamasaki et al. | 30/43.92 |
| 2013/0111759 | A1 * | 5/2013 | Pohl et al. | 30/42 |

* cited by examiner

ELECTRIC SHAVER

BACKGROUND

The present invention relates generally to electric shavers and, more particularly, to a biasing mechanism for an electric shaver with a pivoting head.

Oscillating electric shavers conventionally include a handle and a head mounted on the handle, and the head carries at least one set of inner and outer cutter blades. Each outer cutter blade, which is typically elongated in shape, is supported by a frame of the shaver head and typically defines the skin contacting surface of the shaver. Openings formed in the outer cutter allow hair to protrude through the outer cutter below an inner surface thereof as the shaver is moved over a user's skin. Each inner cutter blade is housed in the shaver head below a corresponding outer cutter and in sliding engagement with the inner surface of the outer cutter. The inner cutter blade is driven by an electric motor, typically housed within the handle, whereby oscillation of the inner cutter acts to cut hairs protruding through the outer cutter.

In some oscillating shaver constructions, the head is pivotably mounted on the handle by a pair of opposed support arms that extend from the top of the handle. Specifically, each support arm extends from the handle to a distal end, and the head is mounted between the support arms such that the pivot axis of the head is located near the distal ends of the support arms. In this manner, the head has a first orientation (e.g., an orientation at which the support arms are substantially centered on the sides of the head). The head is pivotable from the first orientation toward at least one of the front or back of the shaver into a second orientation (e.g., an orientation at which the support arms are not substantially centered on the sides of the head). When the head is not maintained in the second orientation (e.g., when the head is not held against a contour of the skin), the head may be biased back to the first orientation. With this configuration, the shaver head can freely pivot about contours of the skin during shaving, thereby enabling the user to better maintain the outer cutter in contact with the skin. Additionally, after shaving, the head can be biased back toward an orientation that facilitates preventing the shaver head from interfering with an extendable trimmer that may be mounted on the front or back of the handle.

In such a construction, however, the biasing mechanism experiences significant stresses (e.g., repeated tensioning and friction) associated with the repeated pivoting of the head from one orientation to another, which can cause the biasing mechanism to fatigue. There is a need, therefore, for an electric shaver with a biasing mechanism that is configured to provide effective biasing of the shaver head while being able to better withstand repeated stresses associated therewith.

SUMMARY

In one embodiment, an electric shaver generally includes a handle assembly and a head assembly mounted on the handle assembly. The head assembly is pivotable between a first orientation and a second orientation. A biasing element is fixed to one of the head assembly and the handle assembly and is free from being fixed to the other of the head assembly and the handle assembly. The biasing element is configured such that when the head assembly is pivoted from the first orientation into the second orientation the biasing element contacts a surface of the other of the head assembly and the handle assembly and bends to apply a counteracting force that biases the head assembly back toward the first orientation when the head assembly is not held in the second orientation.

In another embodiment, an electric shaver generally includes a handle assembly and a head assembly mounted on the handle assembly. The head assembly is pivotable between a first orientation and a second orientation. A biasing element is fixed to one of the head assembly and the handle assembly and comprises a distal end that is free to be displaced within the other of the head assembly and the handle assembly such that when the head assembly is pivoted from the first orientation into the second orientation the biasing element contacts a surface of the other of the head assembly and the handle assembly and bends to apply a counteracting force that biases the head assembly back toward the first orientation when the head assembly is not held in the second orientation.

In yet another embodiment, a biasing element for a head assembly of an electric shaver generally includes a first substantially linear portion, a second substantially linear portion, and a coiled portion disposed between the first substantially linear portion and the second substantially linear portion.

BRIEF DESCRIPTION OF THE DRAWINGS

Corresponding reference characters indicate corresponding parts throughout the several views of the drawings.

DETAILED DESCRIPTION

Figure 1:
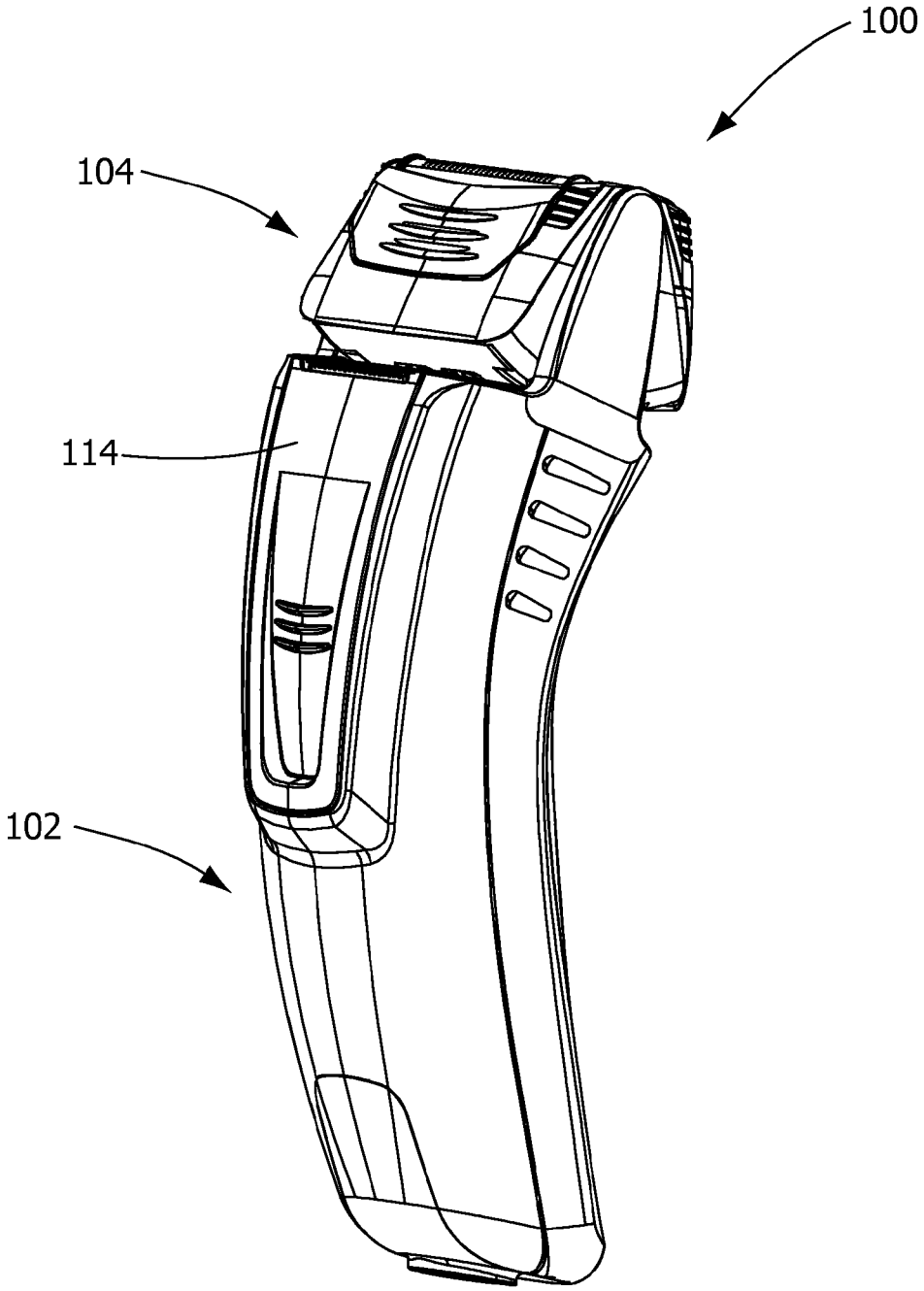
FIG. 1 is a perspective view of one embodiment of an electric shaver.
Figure 2:
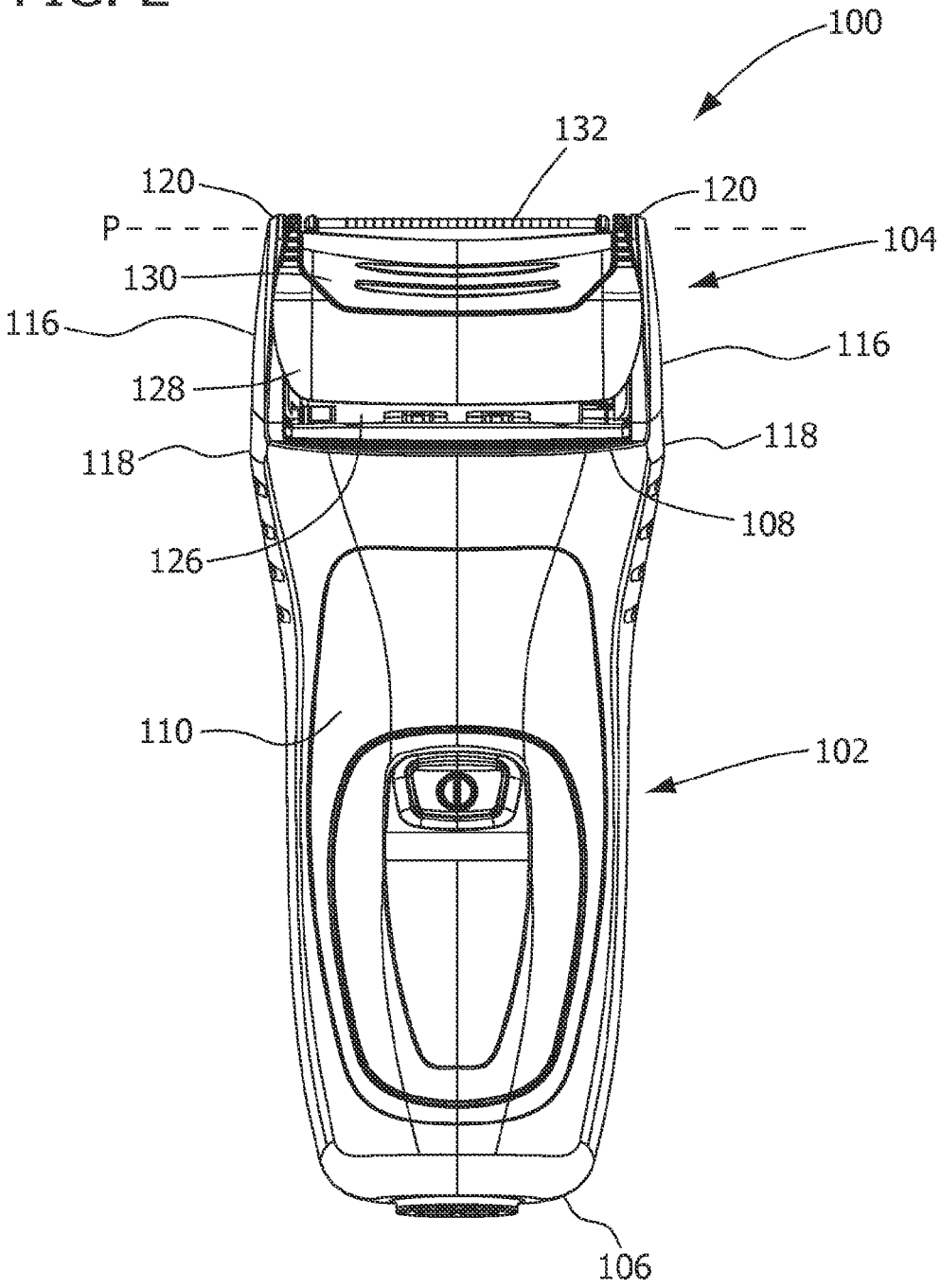
FIG. 2 is a front view of the electric shaver of FIG. 1.
Figure 3:
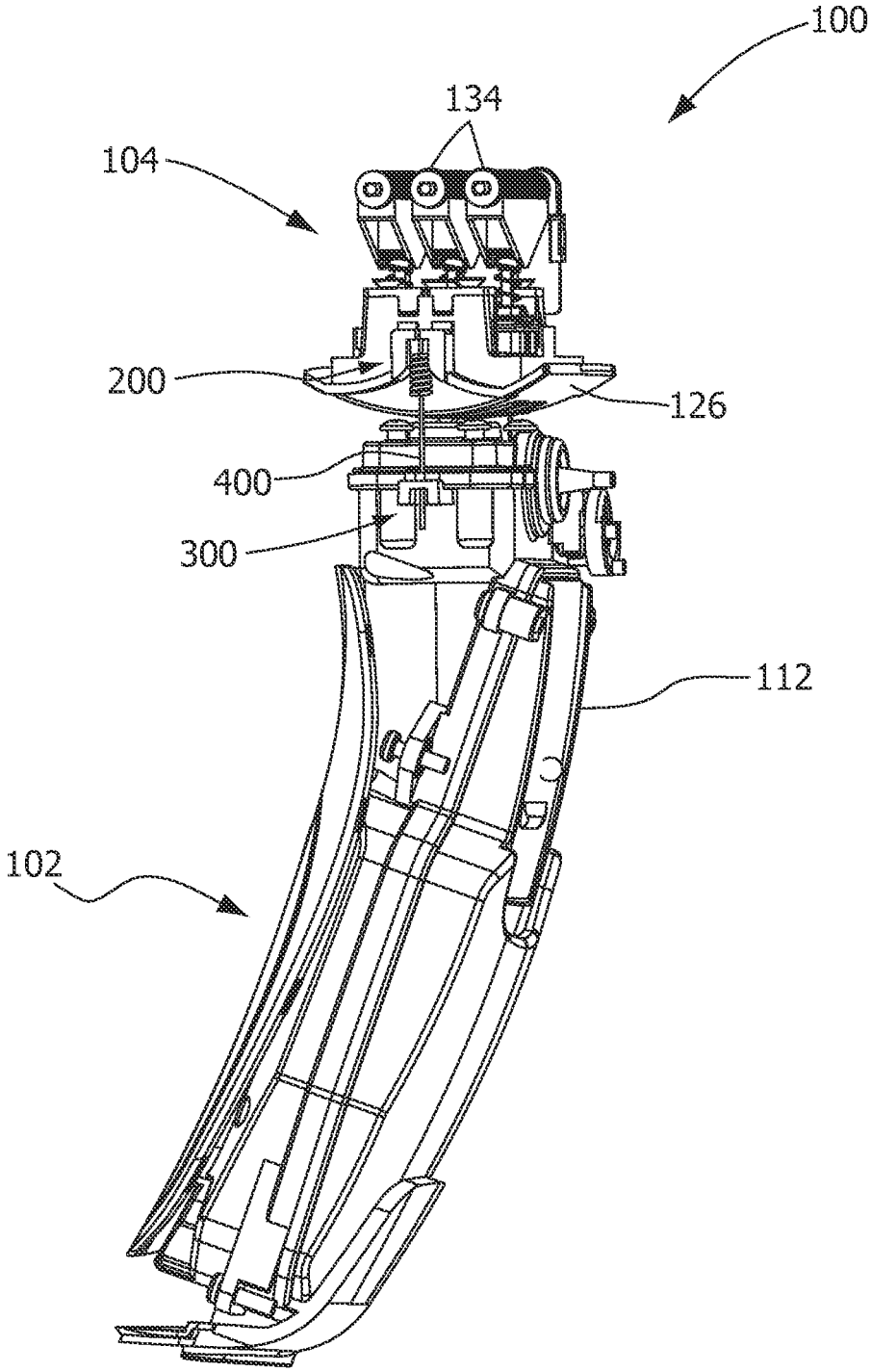
FIG. 3 is a side perspective view of the electric shaver of FIG. 1 with the housing removed to reveal internal construction.

Referring now to the drawings, and in particular to FIGS. 1-3, an electric shaver according to one embodiment is generally indicated in its entirety by the reference numeral 100. In the illustrated embodiment, the shaver 100 is an oscillating shaver that comprises a handle assembly, generally indicated at 102, and a head assembly, generally indicated at 104, mounted on the handle assembly. The handle assembly 102 has a first end 106, a second end 108, and a housing 110 extending from the first end 106 to the second end 108. Disposed within the housing 110 is a core 112 having a suitable motor, gearing and optionally other components that facilitate operation of the shaver 100. A trimmer unit 114 is mounted on the housing 110 in operative connection with the motor and gearing and is adjustable (e.g., manually slideable) to extend upward from the housing during a hair trimming operation. It is understood, though, that the handle assembly 102 may have any suitable configuration without departing from the scope of this invention.

The illustrated handle assembly 102 includes a pair of opposed, upwardly extending support arms 116 suitably connected (in the illustrated embodiment) to the housing 110. In particular, each support arm 116 has a proximal end 118 that is connected to the housing 110 (and/or, for example, a structural component disposed within the housing) and a distal end 120 that is spaced from the housing 110. The head assembly 104 is connected to the support arms 116 via a plurality of fasteners (e.g., a pair of screws) to define a pivot axis P about which the head assembly 104 pivots, and the pivot axis P is located nearer to the distal ends 120 than the proximal ends 118 of the support arms 116.

The illustrated head assembly 104 includes a base 126, a frame 128 connected to the base 126, and an outer cutter support 130 connected to the frame 128 such that the base 126, the frame 128, and the outer cutter support 130 together generally define an enclosure having an interior space. A least one outer cutter (e.g., three outer cutters 132 in the illustrated embodiment) is mounted on the outer cutter support 130, and at least one corresponding inner cutter (e.g., three inner cutters 134 in the illustrated embodiment) is disposed within the interior space of the head assembly 104. The inner cutters 134 are suitably operatively connected to the motor and gearing of the handle assembly 102 such that the inner cutters 134 can be oscillated in sliding engagement with the outer cutters 132. The outer cutter support 130 is suitably releasably attachable to the frame 128 via any suitable mechanism (e.g., snaps, a latch, a catch, etc.) to facilitate emptying hair from interior space and/or cleaning the inner and outer cutters 134, 132.

Figure 10:
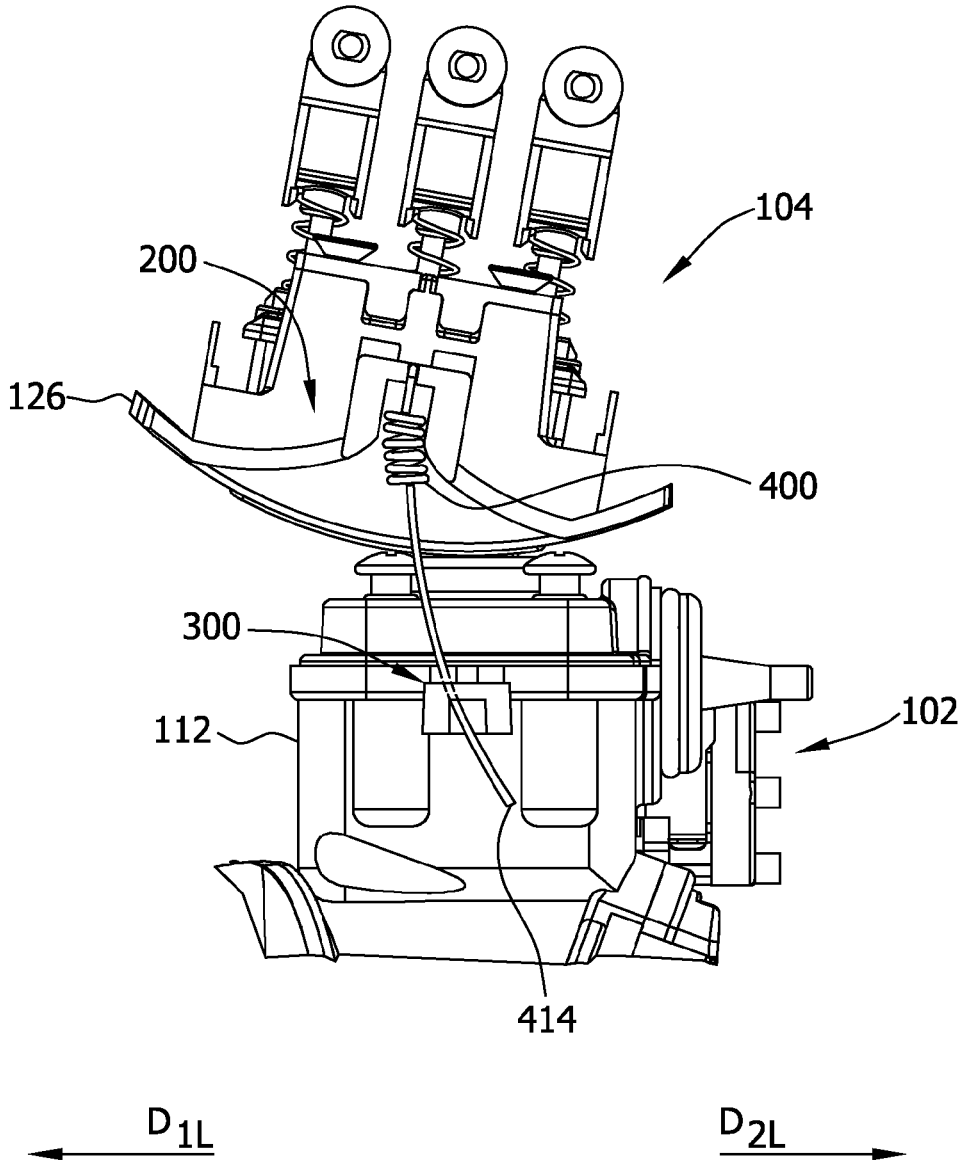
FIG. 10 is a partial side view of the electric shaver of FIG. 8 with the head pivoted out of the first orientation in a first direction.
Figure 11:
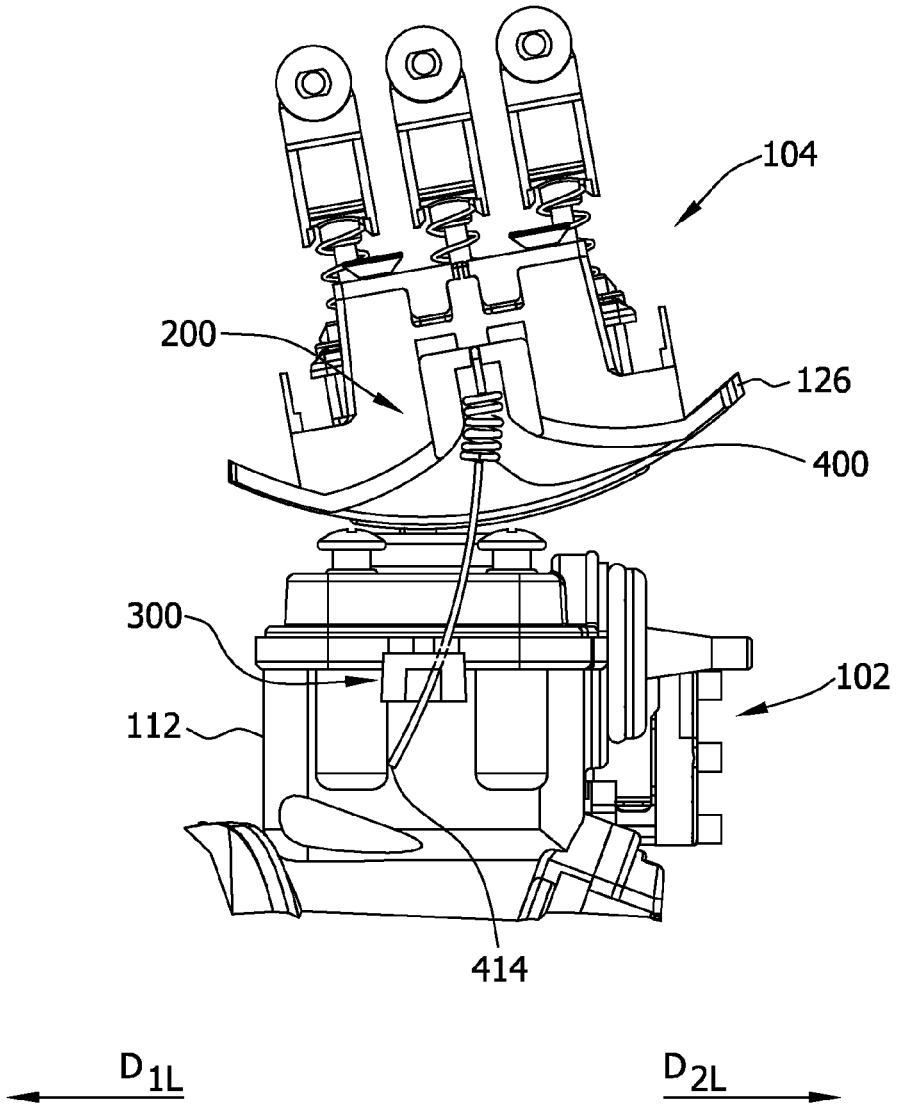
FIG. 11 is a partial side view of the electric shaver of FIG. 8 with the head pivoted out of the first orientation in a second direction.

In the illustrated embodiment, the head assembly 104 further comprises a biasing arrangement, generally indicated at 200, that extends outward from the base 126, and the handle assembly 102 further comprises a biasing tab, generally indicated at 300, that is a stationary part of the handle assembly and extends outward of the core 112. A biasing element 400 is fixed to the biasing arrangement 200 and extends downward through the biasing tab 300, as described in more detail below, to facilitate biasing the head assembly 104 toward a first orientation (e.g., an orientation in which the support arms 116 are substantially centered on the sides of the head assembly 104, as illustrated in FIG. 1) when the head assembly 104 is not pivoted out of the first orientation (FIGS. 10 and 11). It is understood, however, that the biasing element 400 may be configured to bias the head assembly 104 toward any suitable orientation (e.g., toward a first orientation in which the support arms 116 are not substantially centered on the sides of the head assembly 104). It is also understood that the biasing arrangement 200 and/or the biasing tab 300 may extend from any suitable structure of the head and/or handle assemblies 104, 102, respectively. As used herein, the term "fix" refers to securing a portion of a first object to a second object such that the portion of the first object is not displaceable relative to the second object.

Figure 4:
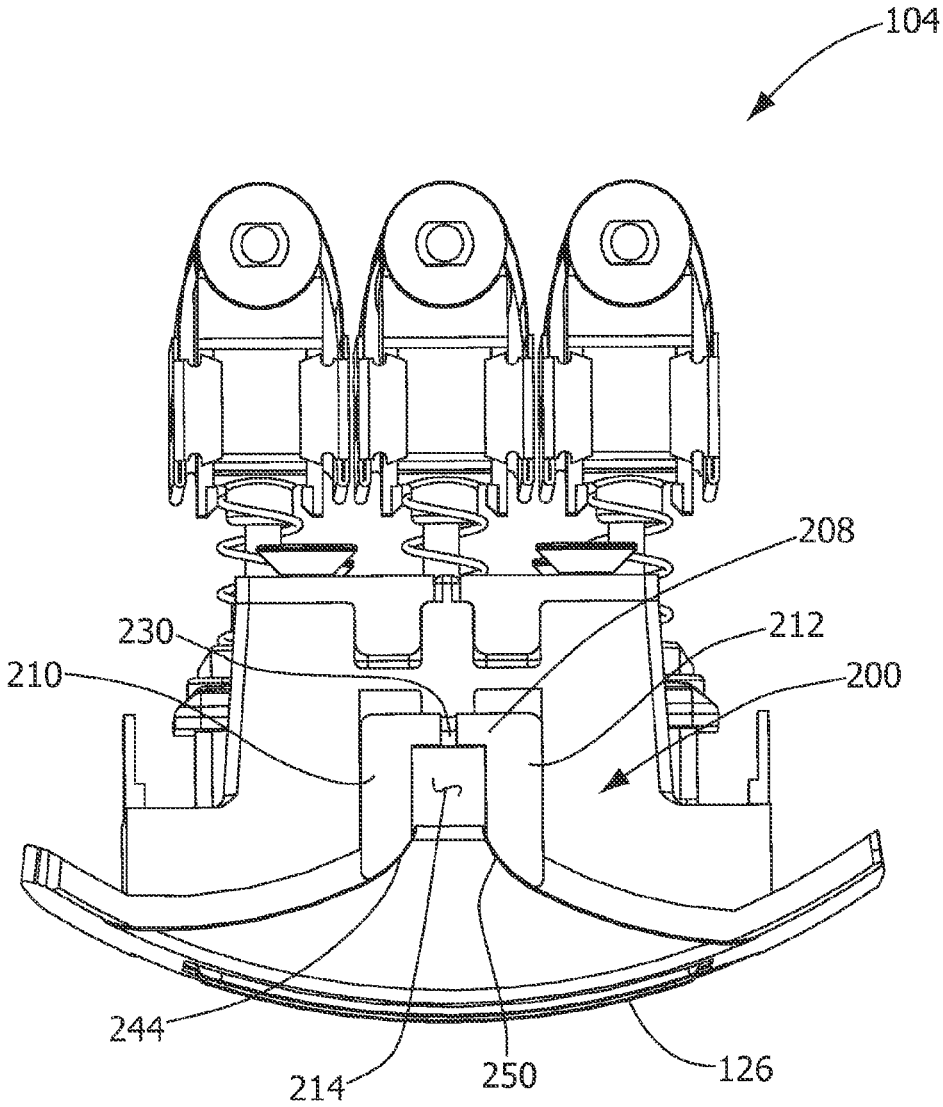
FIG. 4 is a side view of the head of the electric shaver of FIG. 3.
Figure 5:
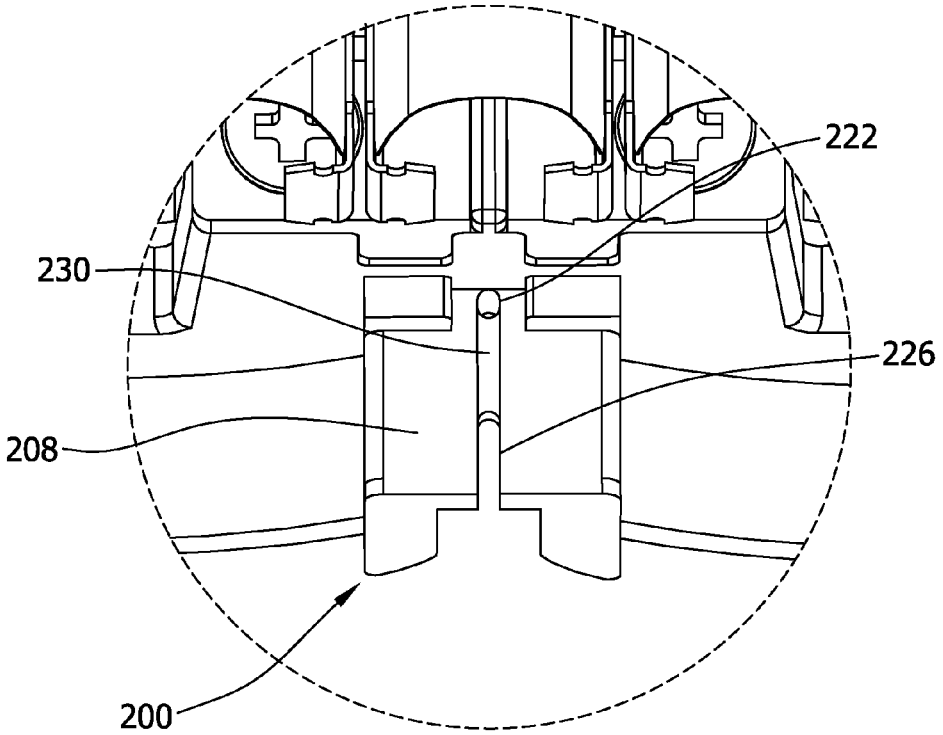
FIG. 5 is an enlarged top view of a portion of the head of FIG. 3.

Referring now to FIGS. 4 and 5, the biasing arrangement 200 has a generally inverted U-shape and includes a top wall 208, a first side wall 210 extending downward from the top wall 208, and a second side wall 212 extending downward from the top wall 208 opposite the first side wall 210 such that the top wall 208, the first side wall 210, and the second side wall 212 collectively define a channel 214. The top wall 208 has an aperture 222, a slot 226, and a groove 230 disposed between the aperture 222 and the slot 226 (FIG. 5) such that the aperture 222, the slot 226, and the groove 230 are substantially collinear and are located substantially centrally between the first and second side walls 210, 212. The first side wall 210 has a bottom surface 244, and the second side wall 212 similarly has a bottom surface 250. The bottom surfaces 244, 250 slant downward and away from the channel 214.

Figure 6:
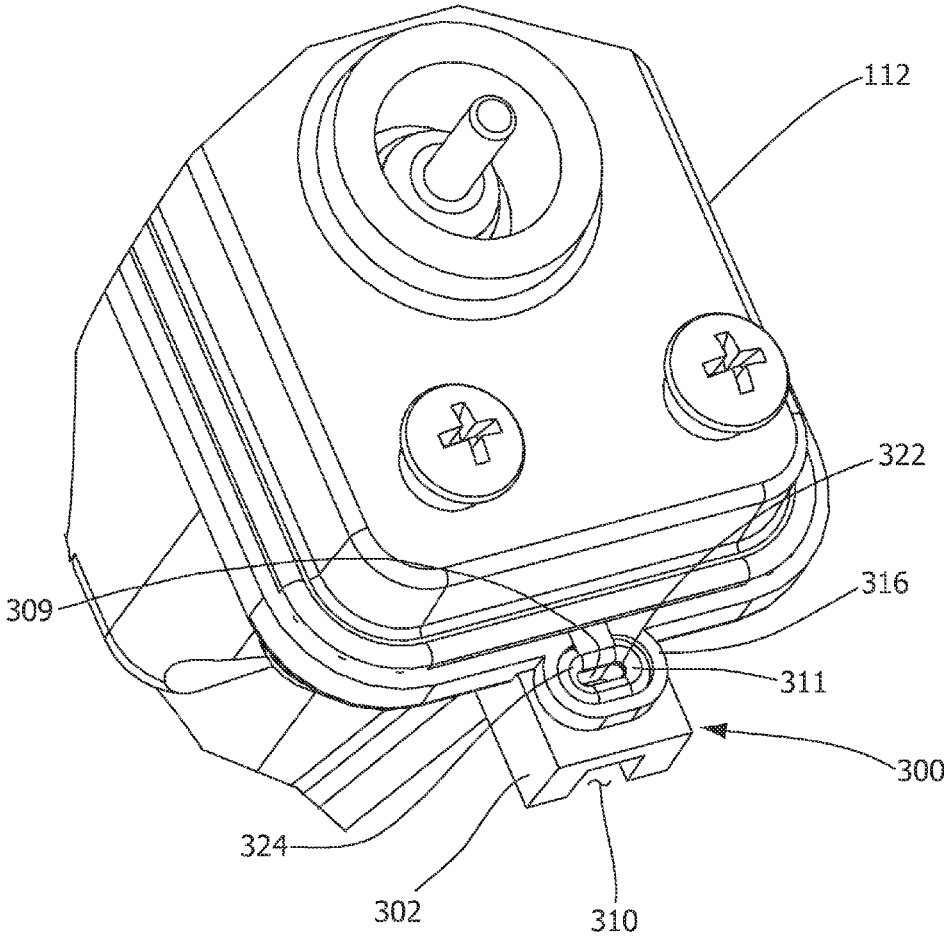
FIG. 6 is an enlarged top perspective view of a portion of the handle of the electric shaver of FIG. 3.

Referring now to FIG. 6, the biasing tab 300 in one embodiment is suitably integrally formed with and extends outward from the core 112 within the housing 110. In other embodiments, however, the biasing tab 300 may extend in any suitable direction from any suitable component of the handle assembly 102. The illustrated biasing tab 300 comprises a base 302 and a rim 316 that extends upward from the base 302. A channel 310 is defined by the inverted U-shape of the base 302, and an opening 322 is defined through the base 302 and the rim 316 by an inner surface 324 such that the opening 322 communicates with the channel 310. An upper portion 311 of the inner surface 324 is obliquely oriented (e.g., is arcuately contoured) relative to a lower portion 309 of the inner surface 324 such that a width of the rim 316 decreases from the base 302 upward. In the illustrated embodiment, the opening 322 is elongated. In another embodiment, the opening 322 may have any suitable shape.

Figure 7:
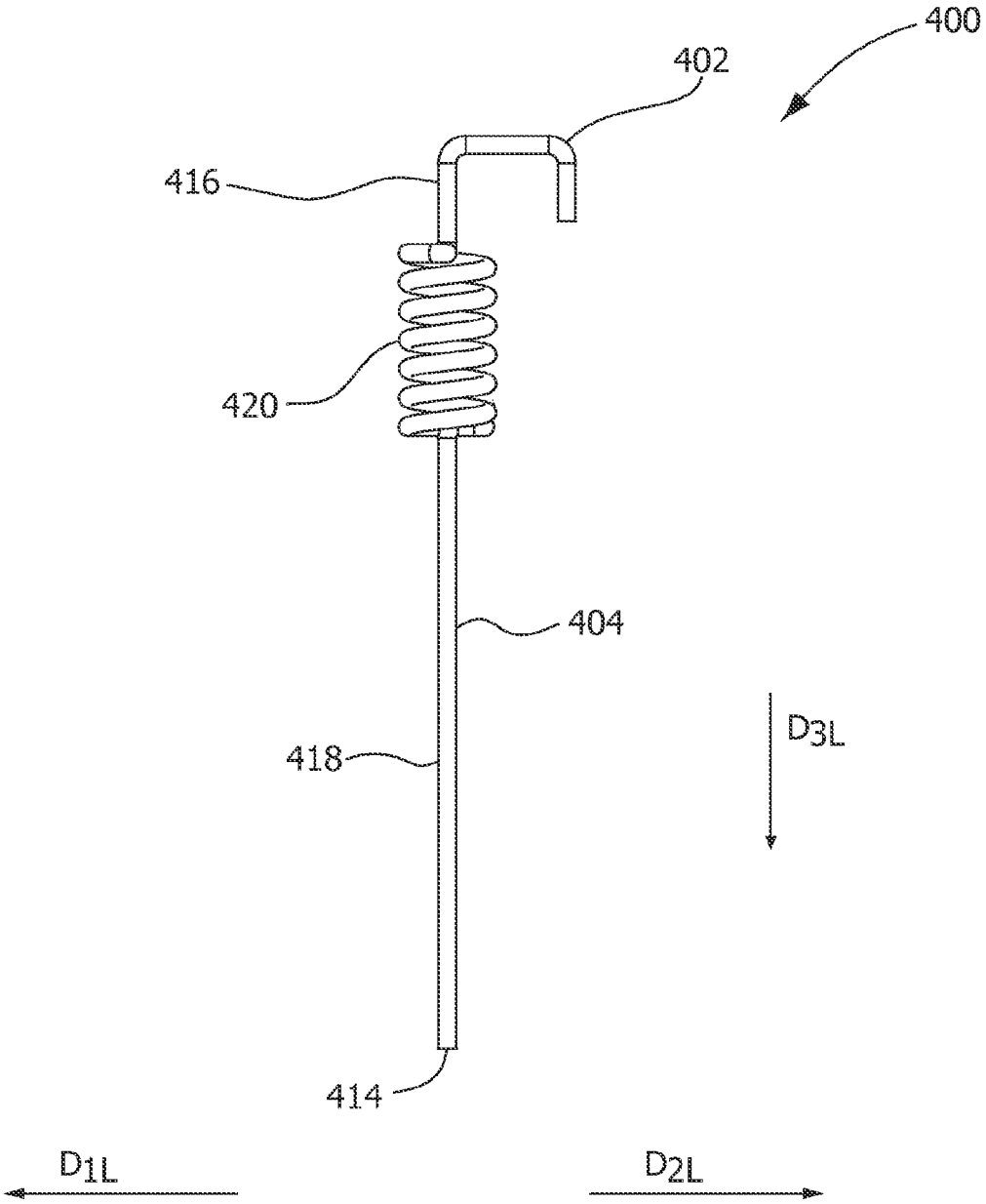
FIG. 7 is a side view of one embodiment of a biasing element of the electric shaver of FIG. 3.

As illustrated in FIG. 7, the biasing element 400 comprises a unitary wire or other suitable material configured to define a flexing segment 404 and a fixing segment (e.g., a hook end 402, in the illustrated embodiment). The flexing segment 404 extends from the hook end 402 to a distal end 414 and has an upper portion 416, a lower portion 418, and a joint 420 disposed between the upper portion 416 and the lower portion 418. The joint 420 is located nearer to the hook end 402 than to the distal end 414 such that the upper portion 416 is shorter than the lower portion 418. In other embodiments, the upper portion 416, the lower portion 418, and the joint 420 may be of any suitable size relative to one another, and the joint 420 may have any suitable location relative to the hook end 402. In the illustrated embodiment, the upper portion 416, the lower portion 418, and the joint 420 are integrally formed from the same material (e.g., a non-corrosive and resilient metallic material, such as a stainless steel material).

Alternatively, the biasing element 400 may be fabricated from any suitable material and may have any suitable configuration that enables the biasing element 400 to function as described herein.

The upper portion 416, the lower portion 418, and the joint 420 are resiliently bendable in at least one lateral direction (e.g., in a first lateral direction $D_{1L}$ and a second lateral direction $D_{2L}$) such that the distal end 414 is laterally displaceable relative to the hook end 402 (FIGS. 10 and 11). Suitably, each of the upper portion 416, the lower portion 418, and the joint 420 has a maximum bending capability, wherein the maximum bending capability of the joint 420 is greater than the maximum bending capability of the upper and lower portions 416, 418. Additionally, the illustrated joint 420 is resiliently stretchable in a longitudinal direction $D_{3L}$ such that the distal end 414 is longitudinally displaceable relative to the hook end 402 (i.e., such that a length of the biasing element 400 is extendable via the joint 420). In one embodiment, the upper and lower portions 416, 418 are substantially linear, and the joint 420 is coiled. In other embodiments, the upper portion 416, the lower portion 418, and/or the joint 420 may have any suitable shape, flexibility, and/or stretchability that enable the biasing element 400 to function as described herein.

Figure 12:
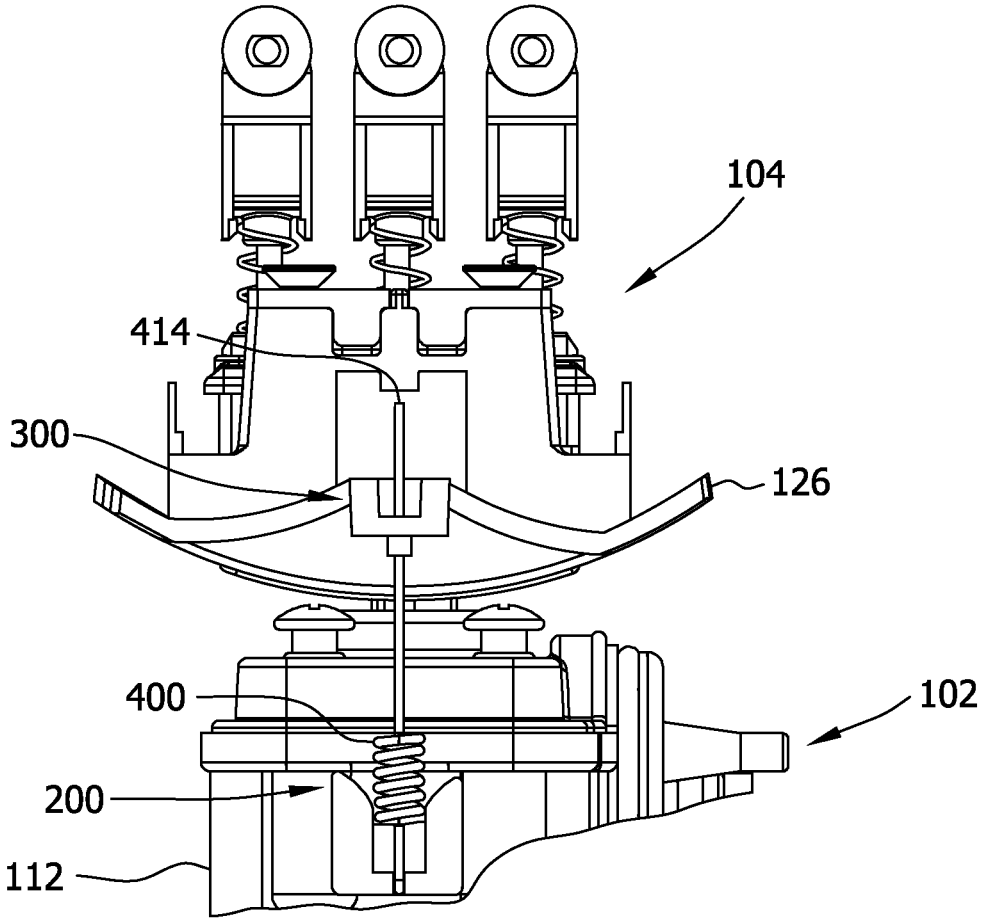
FIG. 12 is a partial side view of another embodiment of an electric shaver with a head of the shaver at a first orientation.

In another embodiment, the biasing element 400 may be disposed on any suitable portion of the shaver 100 (e.g., the biasing element 400 may be disposed centrally within the shaver 100 such that the biasing element 400 extends down from the center of the head assembly 104 and into the center of the handle assembly 102). In some embodiments, the shaver 100 may have multiple biasing elements 400 (e.g., the shaver 100 may have a biasing element 400 on each side of the handle assembly 102). In other embodiments, as shown in FIG. 12, the shaver 100 may be configured such that the biasing element 400 is fixed to the handle assembly 102 and extends upward into an opening formed in the head assembly 104 (e.g., the biasing tab 300 may be formed on the head assembly 104, as opposed to the handle assembly 102). It is also understood that the configuration of the biasing element 400 and/or the opening 322 (e.g., the length of the biasing element 400, the diameter of the biasing element 400, and size of the elongated opening 322) may suitably be selected to achieve any desirable biasing characteristic of the shaver 100.

Figure 9:
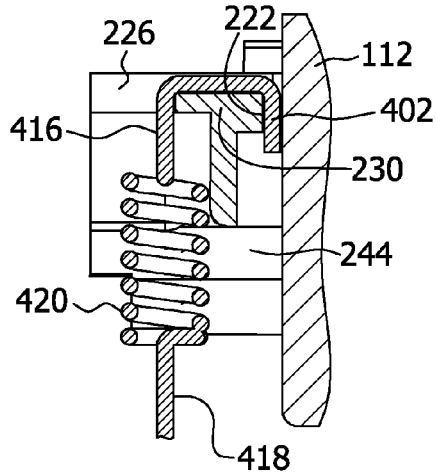
FIG. 9 is an enlarged partial cross-sectional view of the electric shaver of FIG. 8 taken along the plane 9-9.
Figure 8:
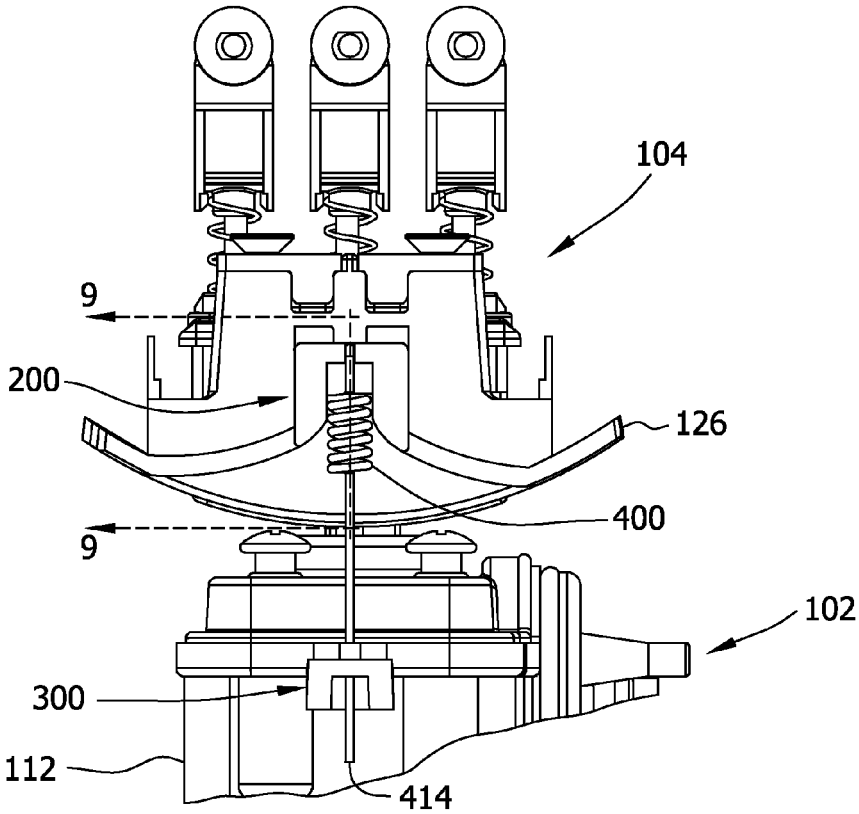
FIG. 8 is a partial side view of the electric shaver of FIG. 3 with the head at a first orientation.

With reference to FIGS. 8 and 9, the head assembly 104 is mounted on the handle assembly 102 such that the head assembly 104 has a first orientation (e.g., the orientation shown in FIG. 8) and is pivotable away from the first orientation about the pivot axis P (FIG. 2). The biasing element 400 is secured to the biasing arrangement 200 such that the hook end 402 extends downward through the aperture 222 and is seated on the groove 230 with the upper portion 416 of the flexing segment 404 extending downward through the slot 226. The joint 420 is suspended within the channel 214, and the lower portion 418 extends through the opening 322 and into the channel 310 (i.e., the second distal end 414 of the lower portion 418 hangs freely and is not fixed to handle assembly 102).

During operation of the shaver 100, the outer cutters 132 of the head assembly 104 contact the skin to be shaved. The head assembly 104 is allowed to pivot about the pivot axis P when the head assembly 104 encounters contours in the skin (e.g., the jaw line of the face) to facilitate keeping the outer cutters 132 in contact with the skin. With reference to FIGS. 10 and 11, if the base 126 of the head assembly 104 pivots away from the first orientation (FIG. 8) in the first lateral direction $D_{1L}$, the joint 420 of the biasing element 400 contacts the second side wall 212 of the biasing arrangement 200 and bends in the first lateral direction $D_{1L}$, and the lower portion 418 contacts the inner surface 324 of the biasing tab 300 such that the lower portion 418 also bends in the first lateral direction $D_{1L}$.

Similarly, if the base 126 of the head assembly 104 pivots away from the first orientation (FIG. 8) in the second lateral direction $D_{2L}$, the joint 420 of the biasing element 400 contacts the first side wall 210 of the biasing arrangement 200 and bends in the second lateral direction $D_{2L}$, and the lower portion 418 contacts the inner surface 324 of the biasing tab 300 such that the lower portion 418 also bends in the second lateral direction $D_{2L}$. Because the joint 420 and the lower portion 418 of the biasing element 400 bend in the lateral direction in which the base 126 of the head assembly 104 pivots, the biasing element 400 applies a force on the head assembly 104 to bias the head assembly 104 back toward the first orientation (FIG. 8) when the head assembly 104 is not held in another orientation (FIGS. 10 and 11).

Because the biasing element is fixed to the head and is not fixed to the handle, the biasing element is permitted a restricted amount of longitudinal and lateral displacement substantially without tension and friction when the head pivots (i.e., the lower portion of the biasing element is permitted to be displaced within the biasing tab opening). Thus, the biasing element experiences less tension and friction than would be experienced if the biasing element was fixed to both the handle and the head. However, since the biasing element resiliently bends during pivoting, the biasing element still imparts an adequate biasing force on the head despite the decreased tension (i.e., the biasing force imparted on the head by the bending adequately compensates for the decreased tensioning). Additionally, because the biasing element has a coiled segment proximate the point at which the biasing element is fixed to the head, the coiled segment is permitted to expand lengthwise during pivoting such that the biasing element experiences less stress (e.g., tension) at the fixing point. In this configuration, the biasing element experiences lower amounts of tension and friction than would normally be experienced by conventional biasing elements, while still providing adequate biasing of the head, thereby increasing the longevity and useful life of the shaver.

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. An electric shaver comprising:

a handle assembly comprising a yoke;

a head assembly pivotably connected to the yoke at a pivot axis, wherein the head assembly is pivotable in a lateral direction about the pivot axis between a first orientation and a second orientation; and a biasing element fixed to one of the head assembly and the handle assembly and free from being fixed to the other of the head assembly and the handle assembly, the biasing element having a distal end that is laterally displaceable relative to the other of the head assembly and the handle assembly such that when the head assembly is pivoted from the first orientation into the second orientation the biasing element contacts a surface of the other of the head assembly and the handle assembly and bends to apply a counteracting force that biases the head assembly back toward the first orientation when the head assembly is not held in the second orientation.

2. The electric shaver set forth in claim 1 wherein the handle assembly comprises a biasing tab having the surface, the surface at least in part defining an opening, wherein the biasing element extends into the opening such that the biasing element contacts the surface within the opening when the head assembly is pivoted from the first orientation into the second orientation.

3. The electric shaver set forth in claim 2 wherein the opening is elongated.

4. The electric shaver set forth in claim 1 wherein the biasing element comprises a first substantially linear portion, a second substantially linear portion, and a coiled portion disposed between the first substantially linear portion and the second substantially linear portion.

5. The electric shaver set forth in claim 4 wherein the head assembly comprises a biasing arrangement that has a generally inverted U-shape defining a channel, the first substantially linear portion fixed to the biasing arrangement such that the coiled portion is suspended within the channel.

6. The electric shaver set forth in claim 5 wherein the biasing arrangement comprises a top wall, a first side wall extending from the top wall, and a second side wall extending from the top wall opposite the first side wall such that the top wall, the first side wall, and the second side wall define the channel.

7. The electric shaver set forth in claim 6 wherein the top wall comprises an aperture and a slot separated by a groove, the aperture and the slot extending through the top wall such that the biasing element extends into the aperture, is seated on the groove, and extends through the slot to suspend the coiled portion within the channel.

8. An electric shaver comprising:

a handle assembly comprising a housing and a pair of opposed support arms extending from the housing, wherein each support arm has a proximal support end and a distal support end;

a head assembly connected to the support arms to define a pivot axis located nearer to the distal support ends than the proximal support ends of the support arms, wherein the head assembly is pivotable in a lateral direction about the pivot axis between a first orientation and a second orientation; and a biasing element fixed to one of the head assembly and the handle assembly and comprising a distal end that is free to be laterally displaced relative to the other of the head assembly and the handle assembly such that when the head assembly is pivoted from the first orientation into the second orientation the biasing element contacts a surface of the other of the head assembly and the handle assembly and bends to apply a counteracting force that biases the head assembly back toward the first orientation when the head assembly is not held in the second orientation.

9. The electric shaver set forth in claim 8 wherein the handle assembly comprises a biasing tab having the surface, the surface at least in part defining an opening, wherein the biasing element extends into the opening such that the biasing element contacts the surface within the opening when the head assembly is pivoted from the first orientation into the second orientation.

10. The electric shaver set forth in claim 9 wherein the opening is elongated.

11. The electric shaver set forth in claim 8 wherein the biasing element comprises a first substantially linear portion, a second substantially linear portion, and a coiled portion disposed between the first substantially linear portion and the second substantially linear portion, the second substantially linear portion having the distal end.

12. The electric shaver set forth in claim 11 wherein the head assembly comprises a biasing arrangement that has a generally inverted U-shape defining a channel, the first substantially linear portion fixed to the biasing arrangement such that the coiled portion is suspended within the channel.

13. The electric shaver set forth in claim 12 wherein the biasing arrangement comprises a top wall, a first side wall extending from the top wall, and a second side wall extending from the top wall opposite the first side wall such that the top wall, the first side wall, and the second side wall define the channel.

14. The electric shaver set forth in claim 13 wherein the top wall comprises an aperture and a slot separated by a groove, the aperture and the slot extending through the top wall such that the biasing element extends into the aperture, is seated on the groove, and extends through the slot to suspend the coiled portion within the channel.

* * * * *